US008794756B2

(12) United States Patent
Toriihara et al.

(10) Patent No.: US 8,794,756 B2
(45) Date of Patent: Aug. 5, 2014

(54) PRINTING APPARATUS

(75) Inventors: Shigeru Toriihara, Kawasaki (JP); Kengo Nieda, Kawasaki (JP); Toshiki Takeuchi, Tokyo (JP); Koichiro Kawaguchi, Yokohama (JP); Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 13/303,614

(22) Filed: Nov. 23, 2011

(65) Prior Publication Data

US 2012/0133719 A1 May 31, 2012

(30) Foreign Application Priority Data

Nov. 29, 2010 (JP) ..... 2010-265756

(51) Int. Cl.

| | |
|---|---|
| ***B41J 2/01*** | (2006.01) |
| ***B65H 5/06*** | (2006.01) |
| ***B65H 5/02*** | (2006.01) |
| ***B41J 11/00*** | (2006.01) |
| ***B65H 20/02*** | (2006.01) |
| ***B41J 13/02*** | (2006.01) |
| ***B65H 85/00*** | (2006.01) |

(52) U.S. Cl.

CPC ..... *B41J 11/0005* (2013.01); *B65H 2801/09* (2013.01); *B65H 2301/33312* (2013.01); *B65H 2701/1311* (2013.01); *B65H 2701/1313* (2013.01); *B65H 2301/517* (2013.01); *B65H 2801/15* (2013.01); *B65H 5/023* (2013.01); *B65H 2511/514* (2013.01); *B65H 5/062* (2013.01); *B65H 20/02* (2013.01); *B41J 13/02* (2013.01); *B65H 2513/50* (2013.01); *B65H 85/00* (2013.01); *B65H 2404/143* (2013.01); *B65H 2404/742* (2013.01)

USPC ..... 347/104; 271/109

(58) Field of Classification Search

CPC ..... B41J 2/01; B65H 5/06
USPC ..... 347/9, 16; 271/109
See application file for complete search history.

(56) References Cited

U.S. PATENT DOCUMENTS

| | | | | |
|---|---|---|---|---|
| 5,742,318 | A * | 4/1998 | Miyauchi et al. | 347/134 |
| 6,343,787 | B1 * | 2/2002 | Kato et al. | 271/274 |
| 2004/0188927 | A1 * | 9/2004 | Tanabe | 271/207 |
| 2007/0194520 | A1 * | 8/2007 | Kusama et al. | 271/225 |

FOREIGN PATENT DOCUMENTS

| | | | |
|---|---|---|---|
| JP | 10-202854 | A | 8/1998 |
| JP | 2006-143442 | A | 6/2006 |
| JP | 2008-179106 | A | 8/2008 |
| JP | 2008-222419 | A | 9/2008 |
| JP | 2009-255564 | A | 11/2009 |
| JP | 2010-100067 | A | 5/2010 |

* cited by examiner

*Primary Examiner* — Alessandro Amari
*Assistant Examiner* — Alexander C Witkowski
(74) *Attorney, Agent, or Firm* — Canon U.S.A., Inc., IP Division

(57) ABSTRACT

A printing apparatus includes: a upstream roller pair arranged on the upstream side of a printing head with respect to a direction in which a sheet is conveyed; and a downstream roller pair arranged on the downstream side of the printing head with respect to the direction, wherein each of the upstream roller pair and the downstream roller pair includes a first roller and a second roller configured to hold the sheet therebetween. In both of the upstream roller pair and the downstream roller pair, a rotation shaft of the second roller is provided to be situated on the downstream side of a rotation shaft of the first roller with respect to the direction.

13 Claims, 11 Drawing Sheets

PRINTING APPARATUS

BACKGROUND OF THE INVENTION

1. Field of the Invention

The present invention relates to a printing apparatus printing an image on a sheet.

2. Description of the Related Art

There is an inkjet type printing apparatus using a continuous sheet rolled up in the form of a roll. Japanese Patent Application Laid-Open No. 2008-222419 discusses an apparatus in which, on the upstream side of a print unit in which a plurality of printing heads are arranged, there is provided a decurling unit configured to remove curl from a continuous sheet.

At the time of its manufacture, a continuous sheet in the form of a roll is pulled under a fixed tension as it is rolled up on a core. In an ordinary manufacturing method, the pulling force applied at the time of rolling up is larger at the end portions than in the central portion of the sheet in the sheet width direction, so that, in some cases, the entire length of the product sheet is larger at both end portions E than in the central portion C. As illustrated in FIG. 1, when compared in a certain unit region, the sheet length L at the end portions is larger than the sheet length I in the central portion. When a sheet whose length thus differs from place to place is drawn out of a roll R, the sheet is straight in the central portion C, whereas, at the end portions E thereof, the sheet is not straight but corrugated due to the surplus length. However, depending upon the sheet manufacturing method, the length of the sheet may be larger in the central portion than at the end portions. In this case, a sheet is corrugated at the central portion. Such corrugation, which is particularly noticeable in a continuous sheet, can also be generated in a cut sheet, which is previously cut in a predetermined length.

It is hard to eliminate such corrugation even by passing the sheet through a decurling unit as discussed in Japanese Patent Application Laid-Open No. 2008-222419. When a corrugated sheet passes through a printing unit, it is possible that the upper portions of the waves come into contact with the printing head. Even if the contact with the printing head does not occur, the distance between the printing head and the sheet surface varies in accordance with the corrugation, so that the requisite flying time for the ink discharged from the printing head to impinge upon the sheet varies, making it rather difficult to perform accurate image printing.

SUMMARY OF THE INVENTION

The present invention is directed to a printing apparatus in which the possibility that the sheet comes into contact with the printing head, or the quality of the printed image is aggravated has been reduced.

According to an aspect of the present invention, a printing apparatus includes: a printing head; an upstream roller pair arranged on the upstream side of the printing head with respect to a direction in which a sheet is conveyed; and a downstream roller pair arranged on the downstream side of the printing head with respect to the direction, wherein each of the upstream roller pair and the downstream roller pair includes a first roller and a second roller configured to hold the sheet therebetween, and wherein in both of the upstream roller pair and the downstream roller pair, a rotation shaft of the second roller is provided to be situated on the downstream side of a rotation shaft of the first roller with respect to the direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the following, an exemplary embodiment of a printing apparatus using an inkjet system will be illustrated. The printing apparatus of this exemplary embodiment is a high speed line printer which uses an elongated continuous sheet (a continuous sheet whose length is larger than the length of a printing unit repeated in the conveyance direction (referred to as one page or a unit image)) and which is applicable to both simplex printing and duplex printing. For example, the printing apparatus is suitable for use in the field where printing is performed in large quantities in a printing laboratory or the like. In the present specification, even if there exist in a mingled state a plurality of small images, characters, and blanks in the region of one print unit (one page), what is contained in that region will be collectively referred to as one unit image. More specifically, the term unit image refers to one print unit (one page) in a case where a plurality of pages is successively printed on a continuous sheet. The length of the unit image differs according to the size of the images to be printed. For example, in the case of an L size photograph, the length of the unit image in the sheet conveyance direction is 135 mm, and, in the case of an A4 size sheet, the length of the unit image in the sheet conveyance direction is 297 mm.

The present invention is widely applicable to printing apparatuses such as a printer, a printer multifunction peripheral, a copying machine, a facsimile apparatus, and apparatuses for manufacturing various types of devices. The printing processing may be of any type; examples of the printing processing system include an inkjet system, an electrophotographic system, a thermal transfer system, a dot impact system, and a liquid development system. Further, the present invention is applicable not only to a printing apparatus but also to sheet processing apparatuses configured to perform various types of processing (such as recording, machining, performing application, irradiation, reading, and inspection) on a continuous sheet.

Figure 1:
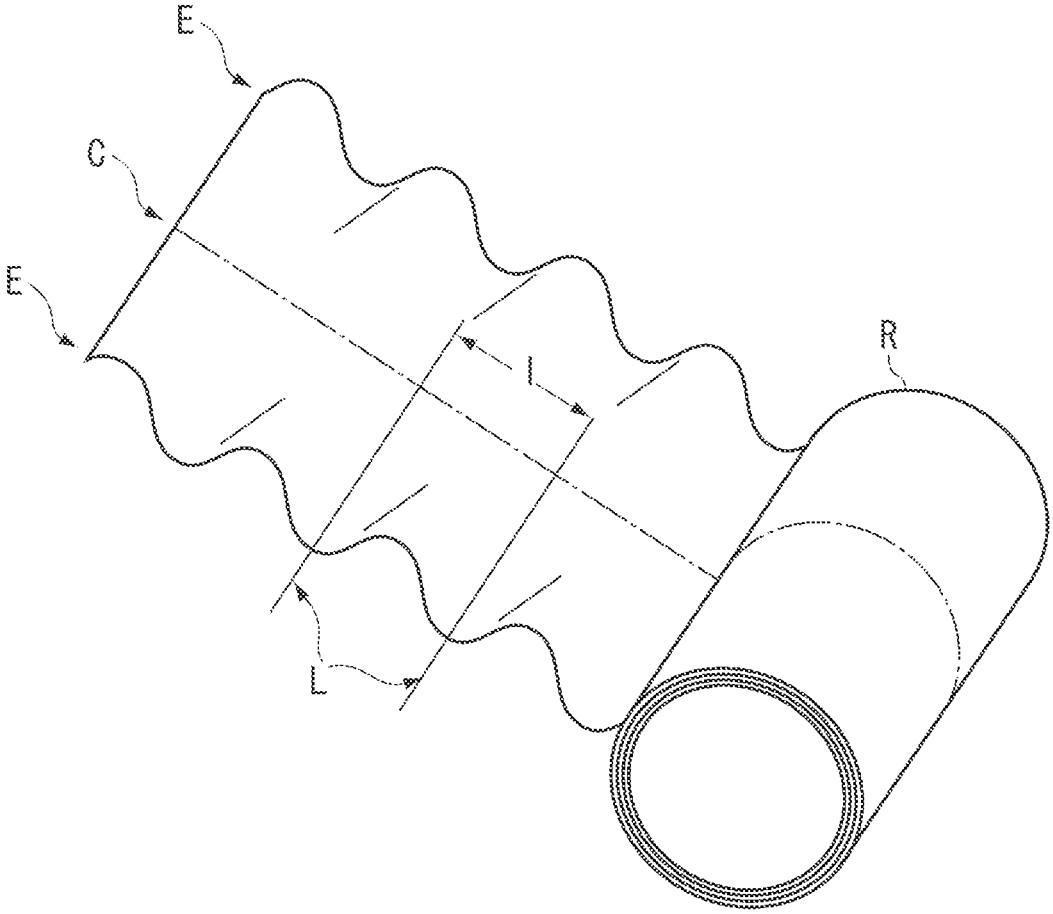
FIG. 1 is a perspective view of a roll sheet as wound off in an elongated form.
Figure 2:
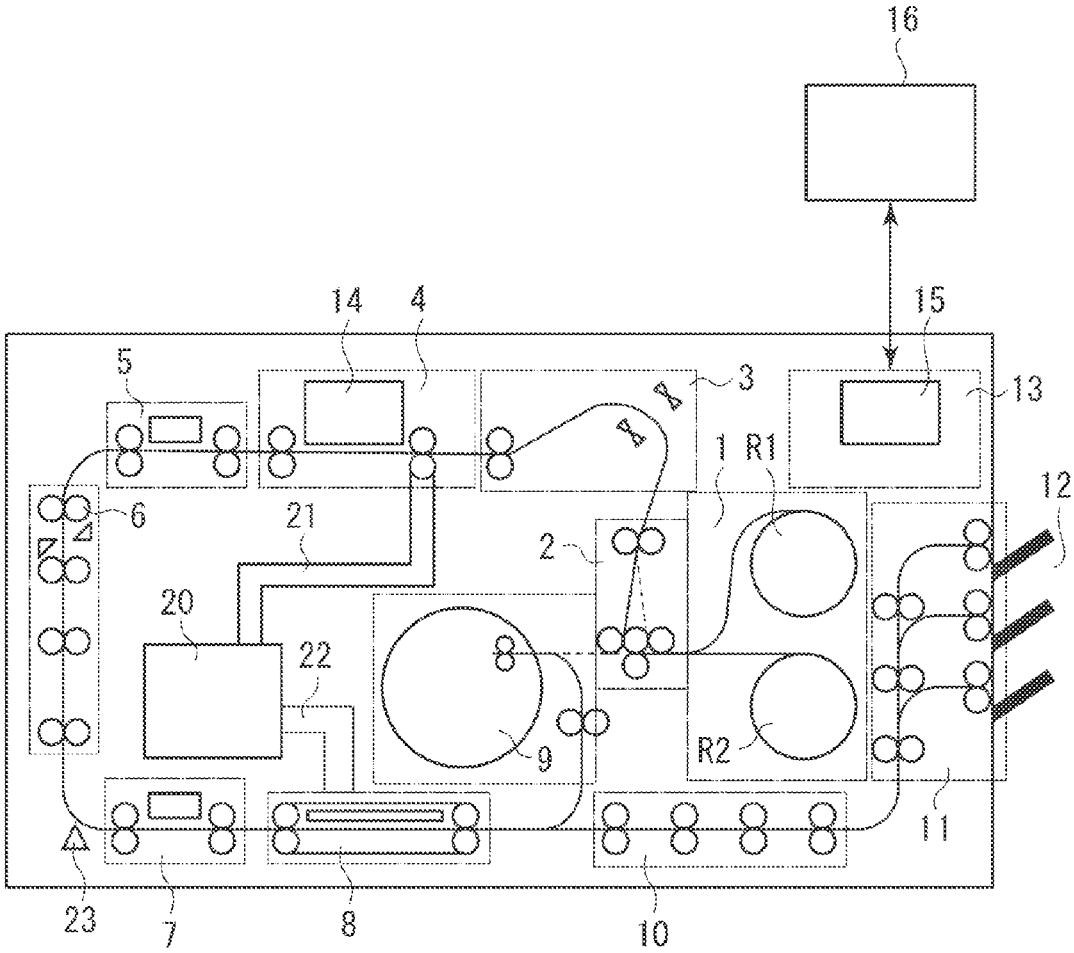
FIG. 2 schematically illustrates the inner construction of a printing apparatus.

FIG. 2 is a schematic sectional view illustrating the inner construction of a printing apparatus. The printing apparatus of the present exemplary embodiment, which uses a sheet in the form of a roll, can perform duplex printing on a first surface of a sheet and on a second surface on the back side thereof. Roughly speaking, the printing apparatus contains a sheet supply unit 1, a decurling unit 2, a skew correction unit 3, a printing unit 4, an inspection unit 5, a cutter unit 6, an information printing unit 7, a drying unit 8, a reversing unit 9, a discharge/conveyance unit 10, a sorter unit 11, a discharge unit 12, a moistening unit 20, and a control unit 13. The sheet is conveyed along a sheet conveyance path indicated by a solid line in the diagram by a conveyance mechanism consisting of roller pairs, belts, etc. while undergoing processing at the above-mentioned units. At an arbitrary position in the sheet conveyance path from the supply unit to the discharge unit, the side nearer to the supply unit is referred to as the "upstream" side, and the opposite side is referred to as the "downstream" side.

The sheet supply unit 1 is a unit for supplying a continuous sheet in the form of a roll while holding the same. The sheet supply unit 1 can accommodate two rolls R1 and R2, making it possible to selectively draw out and supply the sheet from either of the rolls. The number of rolls that can be accommodated is not restricted to two; it may also be one or three or more. The sheet to be used is not restricted to the one in a roll form so long as it is continuous. For example, it is also possible to perforate the continuous sheet per unit length and to fold the sheet at each perforation, so as to accommodate and stack the sheet in the sheet supply unit 1 to be stacked.

The decurling unit 2 is a unit for reducing curl (warpage) in the sheet supplied from the sheet supply unit 1. The decurling unit 2, which uses two pinch rollers for one driving roller, passes the sheet in a curved state so as to impart warpage opposite to the curl, thereby applying a decurling force to reduce the curl.

The skew correction unit 3 is a unit configured to correct skew (inclination at an angle toward the proper advancing direction) of the sheet having passed through the decurling unit 2. A sheet end serving as a reference is pressed against a guide member, whereby the skew of the sheet is corrected.

The printing unit 4 is a unit which performs printing processing on the sheet being conveyed from above by using a printing head 14 to form an image. More particularly, the printing unit 4 is a processing unit for performing a predetermined processing on the sheet. The printing unit 4 is also equipped with a plurality of conveyance rollers for conveying the sheet. The printing head 14 has line type printing heads each having an inkjet type linear nozzle row over a range covering the maximum width of the sheet to be used. On the printing head 14, there are arranged a plurality of printing heads in parallel in the conveyance direction. In the present exemplary embodiment, there are provided seven printing heads respectively corresponding to the seven colors of cyan (C), magenta (M), yellow (Y), light cyan (LC), light magenta (LM), gray (G), and black (K). The number of colors and of printing heads is not restricted to seven. As the inkjet system, it is possible to adopt a system using a heating element, a piezoelectric element, an electrostatic element, or a Micro Electro Mechanical Systems (MEMS) element, etc. The inks of the different colors are respectively supplied to the printing head 14 from ink tanks via ink tubes.

The inspection unit 5 is a unit which optically reads an inspection pattern, image, etc. printed on the sheet by a scanner, and inspects the nozzle condition of the nozzle head, the sheet conveyance condition, the image position, etc. to determine whether or not the image has been correctly printed. The scanner has a charge-couple device (CCD) image sensor and a complementary metal oxide semiconductor (CMOS) image sensor.

The cutter unit 6 is a unit equipped with a mechanical cutter for cutting the sheet in a predetermined length after printing. The cutter unit 6 is also equipped with a plurality of conveyance rollers for sending the sheet to the next process.

The information printing unit 7 is a unit configured to record print information (specific information) such as print serial number and date in a non-printing region of the cut sheet. The recording is performed by the inkjet system, the thermal transfer system or the like, which prints characters and codes. On the upstream side of the information printing unit 7 and on the downstream side of the cutter unit 6, there is provided a sensor 23 detecting the leading edge of the cut sheet. More specifically, the sensor 23 detects an end portion of the sheet between the cutter unit 6 and the recording position where recording is performed by the information printing unit 7; based on the timing with which detection is effected by the sensor 23, the timing with which the information recording is performed by the information printing unit 7 is controlled.

The drying unit 8 is a unit for heating a sheet that has undergone printing at the printing unit 4 to dry the ink imparted to the sheet in a short time. Inside the drying unit 8, hot air is imparted at least from below to the passing sheet to dry the surface to which ink has been imparted. The drying system is not restricted to the one imparting hot air; it is also possible to adopt a system applying electromagnetic waves (ultraviolet rays, infrared rays, etc.) to the sheet surface.

The portion of the sheet conveyance path from the sheet supply unit 1 to the drying unit 8 will be referred to as the first path. The first path is formed so as to make a turn in a U-shape in the section from the printing unit to the drying unit 8, with the cutter unit 6 being situated midway in the U-shaped portion.

The reversing unit 9 is a unit for temporarily rolling up and reversing the continuous sheet whose obverse surface has undergone printing when performing duplex printing. The reversing unit 9 is provided midway in the path (loop path) (referred to as the second path) which serves to supply the sheet that has passed the drying sheet 8 to the printing unit 4 again and which extends from the drying unit 8 to the printing unit 4 via the decurling unit 2. The reversing unit 9 is equipped with a take-up rotary member (drum) for rolling up the sheet. The continuous sheet whose obverse surface has undergone printing and which has not been cut is temporarily rolled up by the take-up rotary member. When the rolling up has been completed, the take-up rotary member makes a reverse rotation, and the sheet that has been rolled up is supplied to the decurling unit 2, and sent to the printing unit 4. Since this sheet has been reversed, it allows printing on the reverse surface at the printing unit 4. The operation of duplex printing will be described in detail below.

The discharge/conveyance unit 10 is a unit for conveying the sheet cut at the cutting unit 6 and dried at the drying unit 8 to deliver the sheet to the sorter unit 11. The discharge/conveyance unit 10 is provided in a path (referred to as the third path) different from the second path in which the reversing unit 9 is provided. To selectively guide the sheet that has been conveyed through the first path, to one of the second path and the third path, there is provided, at the path branching position, a path switching mechanism having a movable flapper.

The sorter unit 11 and the discharge unit 12 are provided by the side of the sheet supply unit 1 and at the end of the third path. The sorter unit 11 is a unit for sorting sheets that have undergone printing into groups as needed. The sorted sheets are discharged onto the discharge portion 12 consisting of a plurality of trays. In this way, through the third path, the sheet passes below the sheet supply unit 1 and is discharged to the side opposite to the printing unit 4 and the drying unit 8 with respect to the sheet supply unit 1.

The moistening unit 20 is a unit for generating a moistening gas (air) and supplying it to the portion between the printing head 14 of the printing unit 4 and the sheet. Due to the moistening gas, drying of the ink of the nozzles of the printing head 14 is suppressed. As the moistening method for the moistening unit 20, it is possible to adopt a vaporization system, a water spraying system, a steam system, etc. Examples of the vaporization system include, other than the rotary type of the present exemplary embodiment, a moisture permeation film type, a drip osmosis type, and a capillary tube type. Examples of the water spray system include an ultrasonic type, a centrifugal type, a high pressure spray type, and two-fluid spray type. Examples of the steam system include a steam piping type, an electrothermal type, and an electrode type. The moistening unit 20 and the printing unit 4 are connected to each other by a first duct 21, and the moistening unit 20 and the drying unit 8 are connected to each other by a second duct 22. At the drying unit 8, there is generated a high-humidity/high-temperature gas when drying the sheet. This gas is introduced into the moistening unit 20 via the second duct 22, and is utilized as auxiliary energy in generating the moistening gas at the moistening unit 20. And, the moistening gas generated at the moistening unit 20 is introduced into the printing unit via the first duct 21. The moistening gas introduced into the printing unit flows from the upstream to the downstream side in the gap between the printing head and the sheet.

The control unit 13 is a unit in charge of the control of the units of the printing apparatus as a whole. The control unit 13 has a central processing unit (CPU), a storage device, a controller (control unit) equipped with various control units, an external interface, and an operation unit 15 allowing the user to perform input/output operation. The operation of the printing apparatus is controlled based on a command from the controller or from a host apparatus 16 such as a host computer connected to the controller via the external interface.

Figure 3:
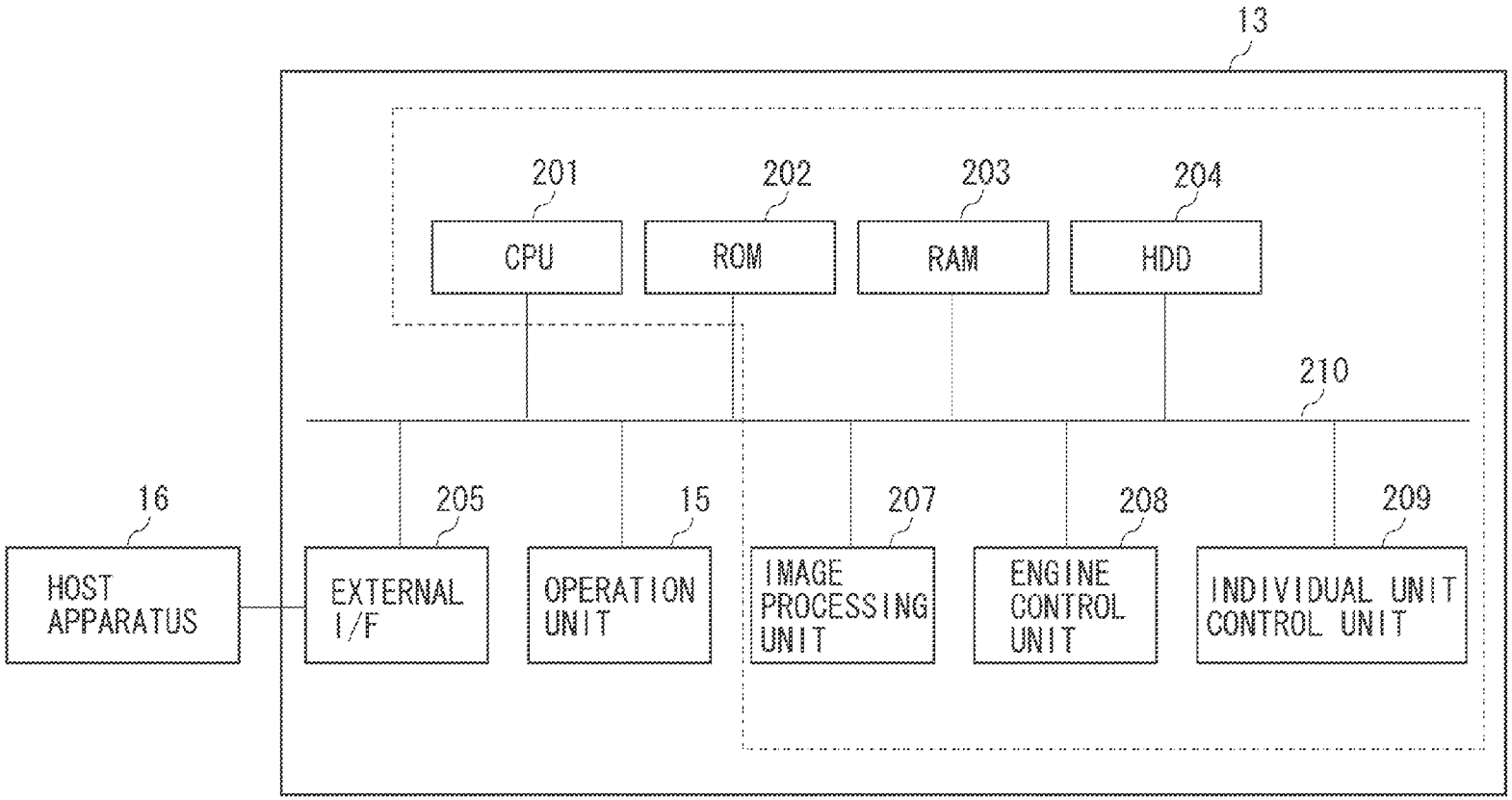
FIG. 3 is a block diagram illustrating a control unit.

FIG. 3 is a block diagram illustrating the concept of the control unit 13. The controller (which is enclosed by the dashed line) included in the control unit 13 is composed of a CPU 201, a read-only memory (ROM) 202, a random-access memory (RAM) 203, a hard disk drive (HDD) 204, an image processing unit 207, an engine control unit 208, and an individual unit control unit 209. The CPU 201 comprehensively controls the operation of each unit of the printing apparatus. The ROM 202 stores fixed data necessary for programs to be executed by the CPU 201 and for the various operations of the printing apparatus. The RAM 203 is used as the work area for the CPU 201 and as a temporary storage region for various reception data, and stores various setting data. The HDD 204 is capable of storing and reading the programs to be executed by the CPU 201, printing data, and the requisite setting information for the various operations of the printing apparatus. The operation unit 15 is an input/output interface between the printing apparatus and the user; it includes an input unit formed by hard keys and a touch panel, and an output unit formed by a display which presents information and a sound generator. For example, a display with a touch panel is used, which indicates to the user the apparatus operation status, printing condition, maintenance information (such as remaining ink amount, remaining sheet amount, and maintenance status), etc. The user can input various items of information through the touch panel.

A unit which requires high speed data processing is provided with a dedicated processing unit. The image processing unit 207 performs image processing on printing data handled by the printing apparatus. The color space of the input image data (e.g., YCbCr) is converted to a standard RGB color space (e.g., sRGB). Further, various image processing operations such as resolution conversion, image analysis, and image correction, are conducted on the image data as needed. The printing data obtained through these image processing operations is stored in the RAM 203 or the HDD 204. The engine control unit 208 controls drive of the printing head 14 of the printing unit 4 according to the printing data based on the control command received from the CPU 201 or the like. Further, the engine control unit 208 controls the conveyance mechanism of each unit in the printing apparatus. The individual unit control unit 209 is a sub controller for individually controlling each of the sheet supply unit 1, the decurling unit 2, the skew correction unit 3, the inspection unit 5, the cutter unit 6, the information printing unit 7, the drying unit 8, the reversing unit 9, the discharge/conveyance unit 10, the sorter unit 11, the discharge unit 12, and the moistening unit 20. The operation of each unit is controlled by the individual unit control unit 209 based on the command from the CPU 201. The external interface 205 is an interface (I/F) for connecting the controller to the host apparatus 16; it is a local I/F or a network I/F. The above components are connected together by a system bus 210.

The host apparatus 16 is an apparatus serving as the supply source of image data for causing the printing apparatus to perform printing. The host apparatus 16 may be a general-purpose or a dedicated computer, or a dedicated imaging apparatus such as an image capture with an image reader unit, a digital camera, or a photo storage. In the case where the host apparatus 16 is a computer, an operation system (OS), application software for generating image data, and a printer driver for the printing apparatus are installed in the storage device contained in the computer. It is not indispensable to realize all of the above processing operations through software; it is also possible that a part or all of the processing operations are realized through hardware.

Next, the basic operation at the time of printing will be illustrated. The printing operations differ between simplex printing mode and duplex printing mode, so that the printing operation for each mode will be described.

Figure 4A:
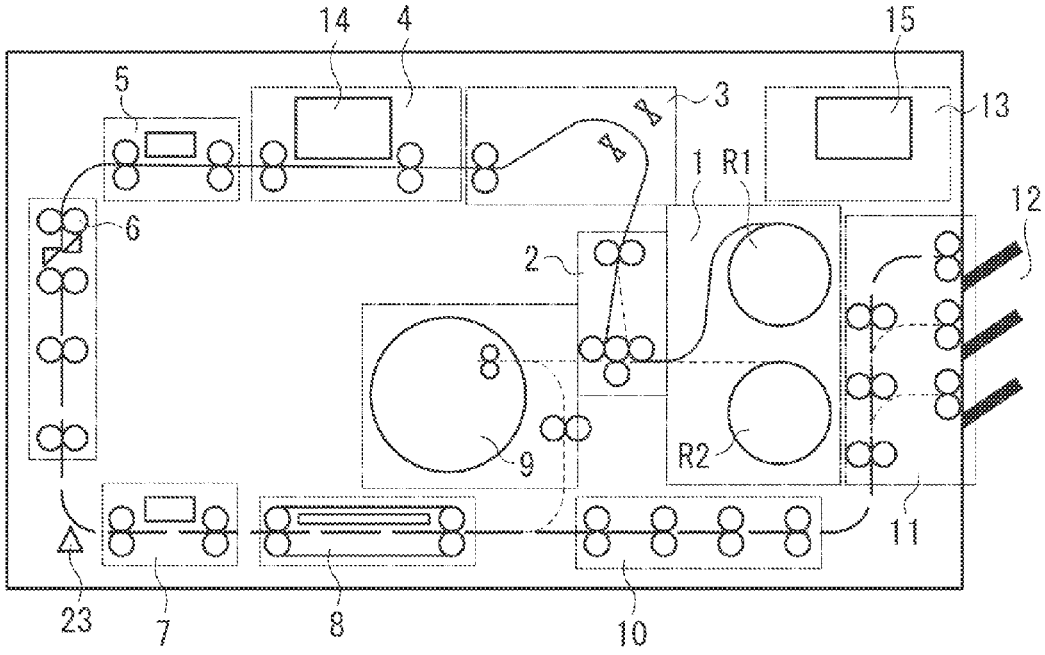
FIGS. 4A and 4B are diagrams for illustrating the operations in simplex/duplex printing modes.

FIG. 4A is a diagram for illustrating the operation in simplex printing mode. The sheet supplied from the sheet supply unit 1 and subjected to processing at the decurling unit 2 and the skew correction unit 3 undergoes printing on the obverse surface (the first surface) at the printing unit 4. A plurality of images is formed side by side on an elongated continuous sheet by successively printing images (unit images) of a predetermined unit length in the conveyance direction. The sheet that has undergone printing is passed by way of the inspection unit 5 before being cut into the unit images at the cutter unit 6. Printing information is recorded on the reverse surfaces of the cut sheets by the information printing unit 7 as needed. And, the cut sheets are conveyed one by one to the drying unit 8 to be dried. After this, they are conveyed by way of the discharge/conveyance unit 10 and are successively discharged onto and stacked on the discharge unit 12 of the sorter unit 11. On the other hand, the portion of the sheet remaining on the printing unit 4 side after the cutting of the last unit image is fed back to the sheet supply unit 1 and rolled up by the roll R1 or R2. In this way, in simplex printing, the sheet undergoes processing by passing through the first path and the third path; it does not pass through the second path.

Figure 4B:
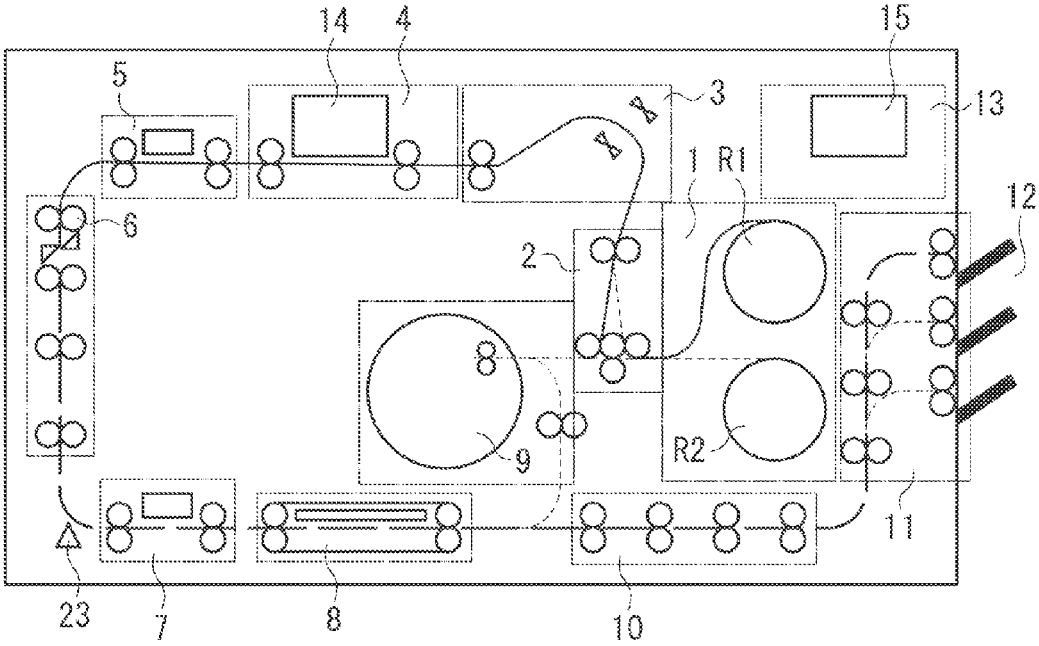

FIG. 4B is a diagram for illustrating the operation for duplex printing. In duplex printing, a reverse side (second surface) printing sequence is executed subsequent to an observe side (first surface) printing sequence. In the obverse side printing sequence, the operations at the sheet supply unit 1 to the inspection unit 5 are the same as those in the simplex printing operation described above. In the cutter unit 6, no cutting operation is conducted; instead, the sheet is conveyed to the drying unit 8 as the continuous sheet as it is. After the drying of the surface ink at the drying unit 8, the sheet is guided not to the discharge/conveyance unit 10 side path (the third path) but to the reversing unit 9 side path (the second path). In the second path, the sheet is rolled up by the take-up rotary member of the reversing unit 9 rotating in the forward direction (counterclockwise as seen in the diagram). When the intended printing on the obverse surface has been completed in the printing unit 4, the trailing edge of the printing region of the continuous sheet is cut by the cutter unit 6. Using the cutting position as a reference, the portion of the continuous sheet on the downstream side with respect to the conveyance direction (the printed side) is conveyed by way of the drying unit 8 and is all rolled up by the reversing unit 9 up to the sheet trailing edge (cutting position). On the other hand, simultaneously with this rolling up, the portion of the continuous sheet left on the upstream side of the cutting position with respect to the conveyance direction (the printing unit 4 side) is restored to the sheet supply unit 1 so that the sheet leading edge (cutting position) may not remain at the decurling unit 2, and this portion of the sheet is rolled up by the roll R1 or R2. Due to this restoring, it is possible to avoid collision with the sheet to be supplied again in the reverse side printing sequence described below.

After the obverse side printing sequence described above, the printing apparatus is switched to the reverse side printing sequence. The take-up rotary member of the reversing unit 9 rotates in a direction opposite to that in the case of rolling up (clockwise as seen in the diagram). The end portion of the rolled up sheet (the sheet trailing edge at the time of rolling up becomes the sheet leading edge at the time of sending out) is sent into the decurling unit 2 along the path indicated by the dashed line in the diagram. At the decurling unit 2, the curl imparted by the take-up rotary member is corrected. More specifically, in the first path, the decurling unit 2 is provided between the sheet supply unit 1 and the printing unit 4, and, in the second path, is provided between the reversing unit 9 and the printing unit 4, constituting a common unit serving to perform decurling in both paths. The sheet which has been reversed is sent to the printing unit 4 by way of the skew correction unit 3, and undergoes printing on the reverse side thereof. The sheet that has undergone printing, is conveyed by way of the inspection unit 5, and is cut in a predetermined unit length by the cutter unit 6. Since the cut sheets have undergone printing on both sides, no recording is performed thereon at the information printing unit 7. The cut sheets are conveyed one by one to the drying unit 8, and are conveyed by way of the discharge/conveyance unit 10 before being successively discharged onto the discharge unit 12 of the sorter unit 11. In this way, in duplex printing, the sheets are passed through the first path, the second path, the first path, and the third path, in that order, to undergo processing.

Figure 5:
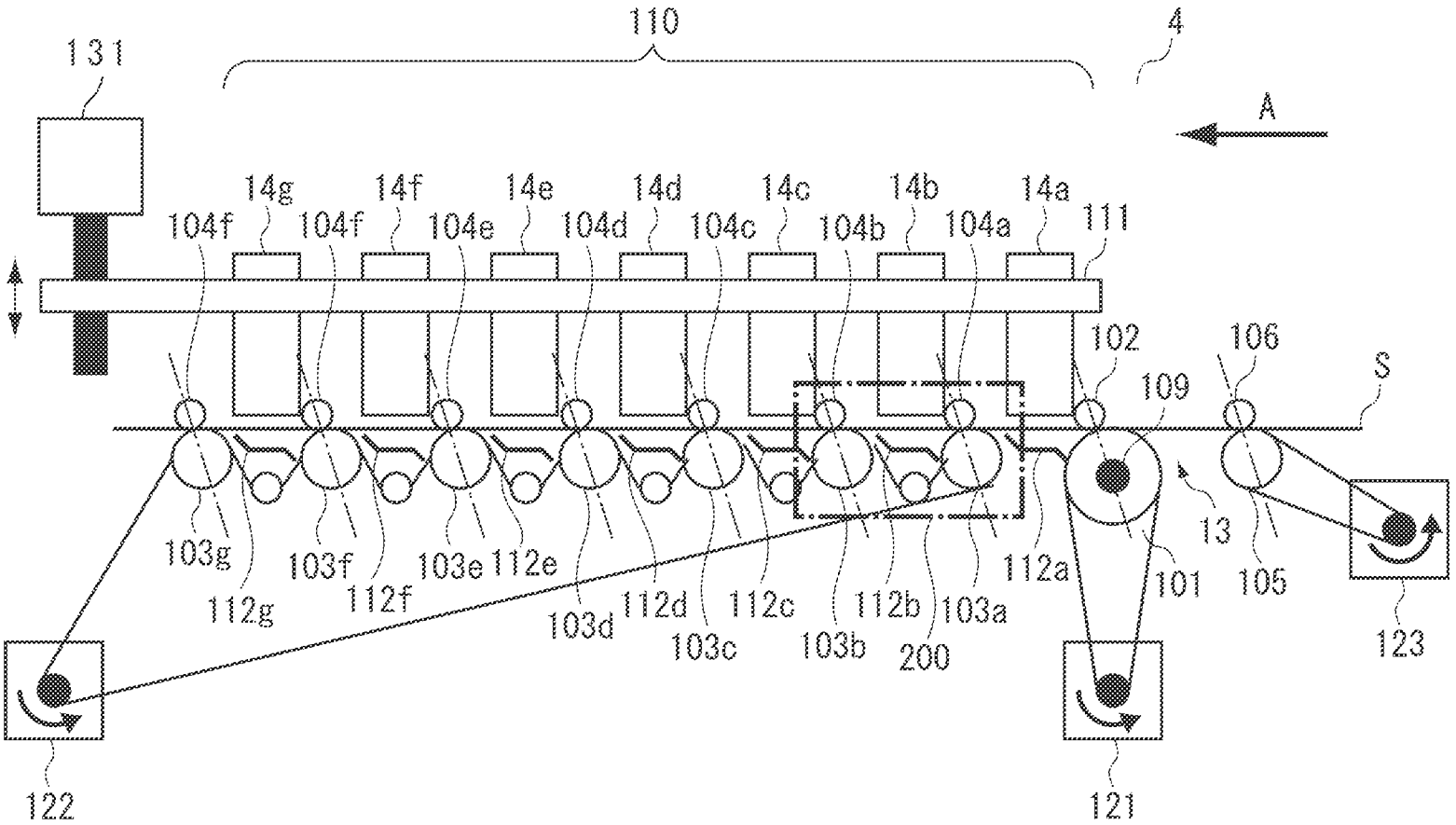
FIG. 5 is a sectional view illustrating the construction of a printing unit.

Next, the printing unit 4 in the printer constructed as described above will be illustrated in more detail. FIG. 5 is a sectional view illustrating the printing unit 4 with the printing head 14 mounted thereto, and FIG. 6 is a perspective view illustrating in detail the structure of two roller pairs adjacent to each other indicated by dotted lines.

In the printing unit 4, the sheet S is conveyed in the direction of the arrow A in the diagram by the three kinds of roller pair: supply rollers, first conveyance rollers, and second conveyance roller group. The supply rollers are a roller pair consisting of a driven roller 106 (pinch roller) on the upper side having no driving force and configured to be driven to rotate, and a driving roller 105 on the lower side to which a driving force is imparted by a driving motor 123. The first conveyance rollers are a roller pair consisting of a driven roller 102 (pinch roller) on the upper side having no driving force and configured to be driven to rotate, and a driving roller 101 on the lower side to which a driving force is imparted by a driving motor 121. The second conveyance roller group consists of a plurality of (seven) roller pairs consisting of driven rollers 104*a* through 104*g* on the upper side having no driving force and configured to be driven to rotate, and driving rollers 103*a* through 103*g* on the lower side to which a driving force is imparted by a common driving motor 122. The plurality of roller pairs is provided at equal intervals. The first conveyance rollers dominate the conveyance speed of the entire printing unit 4, and the driving roller 101, which constitutes the same, is provided with a rotary encoder 109 detecting the rotating condition.

Figure 6:
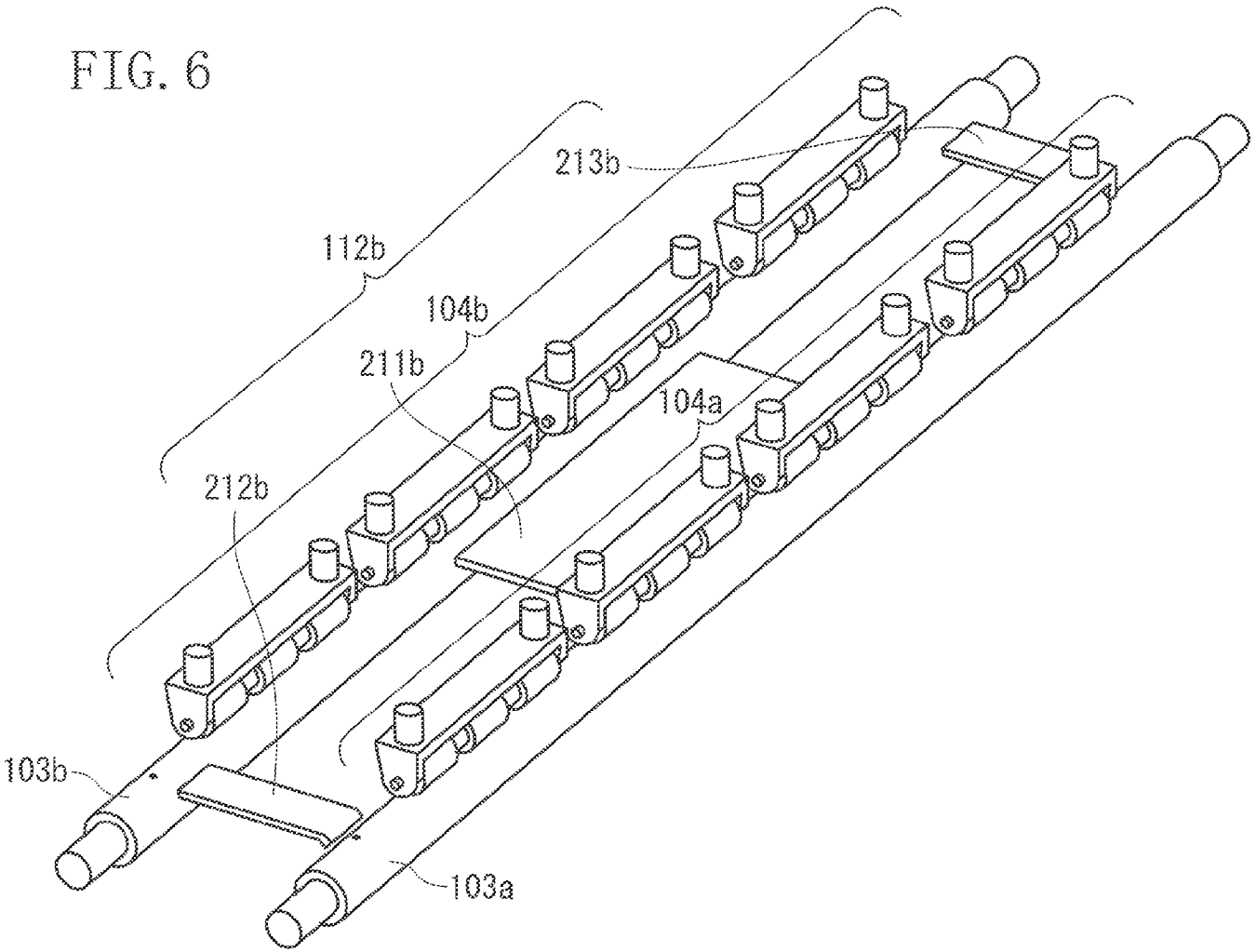
FIG. 6 is a perspective view illustrating in detail the construction of two adjacent roller pairs.

As illustrated in FIG. 6, each of the driving rollers 103*a* and 103*b* is a single roller member continuous in the axial direction of the rotation shafts. In contrast, each of the driven rollers 104*a* and 104*b* is divided into four units along the axial direction of the rotation shafts, each unit consisting of three small rollers. Between the roller pair adjacent to each other (an upstream roller pair and a downstream roller pair), guide members 112*b* are provided. The guide members 112*b* consist of three guides: a guide 211*b* fixed in position at the center, and guides 212*b* and 213*b* provided on both sides thereof so as to be movable in the sheet width direction. As illustrated in the sectional view of FIG. 5, the guide member 112*b* is shaped to be raised on the downstream side and lowered on the upstream side with respect to the sheet conveyance direction A, with the raised portion being held in contact with the reverse side of the sheet.

Regarding the rotational peripheral speed (sheet conveyance speed) of each roller pair, it is set to gradually increase from the upstream toward the downstream side. In other words, the rotational peripheral speeds of the roller pairs are in the following relationship: the supply rollers>the first conveyance rollers>the second conveyance roller group. The plurality of roller pairs of the second conveyance roller group may be of equal peripheral speed, or a peripheral speed may gradually increase from the upstream toward the downstream side. Regarding the nipping force with which each roller pair holds the sheet, that of the first conveyance rollers is the largest. More specifically, the setting is made regarding the nipping force as follows: the first conveyance rollers>the second conveyance roller group, the first conveyance rollers>the supply rollers. The nipping force is determined by the spring pressure of the spring pressing the driven roller against the driving roller. In the present exemplary embodiment, the spring pressure of the driven roller 106 of the supply rollers is 1 kgf, the spring pressure of the driven roller 102 of the first conveyance rollers is 10 to 20 kgf, and the spring pressure of the seven driven rollers 104*a* through 104*g* of the second conveyance roller group is in total 1 kgf. In this way, the further on the downstream side, the higher the rotational peripheral speed, and, the further on the upstream side, the larger the nipping force, whereby weak tension is imparted to the sheet S between the rollers of each roller pair, making it possible to decrease the sheet corrugation described below.

In the printing region 110 where the second conveyance roller group is situated, there are arranged, in the sheet conveyance direction, seven line type printing heads 14*a* through 14*g* corresponding to the inks of the plurality of colors. The intervals between the adjacent printing heads are equal. These printing heads are integrally held by a head holder 111. The head holder 111 holding the printing head can be displaced vertically by a driving mechanism 131, adjusting the interval between the printing heads and the sheet. The printing heads 14*a* through 14*g* and the seven driven rollers 104*a* through 104*g* of the second conveyance roller group are arranged alternately one by one above the sheet. At the positions opposed to the seven printing heads, there are provided guide members 112*a* through 112*g*. The guide members 112*a* through 112*g* are configured to be brought into contact with the reverse printing side of the sheet S to guide the sheet when the leading edge of the sheet having passed a roller pair is introduced into the next roller pair. The guide members may also be retracted from the reverse side of the sheet when the leading edge of the sheet is held by the next roller pair.

Here, attention will be focused on a roller pair (which, in this example, is the driving roller 103*a* and the driven roller 104*a*) included in the second conveyance roller group. An imaginary plane defined to include the rotation axis of the driving roller 103*a* (first roller) and the rotation axis of the driven roller 104*a* (second roller) is presumed. In the present specification, the term "rotation axis" refers to the rotation center of a shaft. In this imaginary plane, the positional relationship between the driving roller 103*a* and the driven roller 104*a* is determined such that the direction in which the sheet is conveyed (conveyance direction A) is inclined toward a plane extending in the vertical direction by an inclination angle $\alpha$ ($\alpha>0$). The inclination is such that the driven roller 104*a* is placed on the downstream side of the driving roller 103*a* with respect to the conveyance direction A. From another viewpoint, when an imaginary plane is presumed, which is in contact with the nipping position where the sheet is held by the driving roller 103*a* and the driven roller 104*a*, this imaginary plane is not parallel to the sheet conveyance direction A but is inclined by an inclination angle ($90-\alpha$). From still another viewpoint, the rotation axis of the driven roller 104*a* is offset to shift to the downstream side of the rotation axis of the driving roller 103*a* with respect to the conveyance direction A. In the present specification, the "sheet conveyance direction A" or the "direction in which the sheet is conveyed" means the macroscopic moving direction of the sheet from the upstream side toward the downstream side in the printing unit 4 as a whole; it does not mean a local, microscopic orientation of the sheet, which is corrugated.

This also applies to the other roller pairs included in the second conveyance roller group, the supply rollers, and the first conveyance rollers. More specifically, the plane defined to include the rotation axis of the driving roller (first roller) and the rotation axis of the driven roller (second roller) is determined such that the above-mentioned plane is all inclined in the same direction by the inclination angle $\alpha$ toward a plane extending in the vertical direction. The inclining direction (offset direction) of each roller pair is not restricted to that of this example; all the roller pairs may be inclined in the opposite direction. More specifically, it is also possible to adopt an arrangement in which offsetting is effected such that the rotation axis of the driven roller is situated on the upstream side of the rotation axis of the driving roller in the conveyance direction A. While it is necessary that in the upstream roller pair and the downstream roller pair the inclination direction (offset direction) is the same, their inclination angles may be different.

Figure 7A:
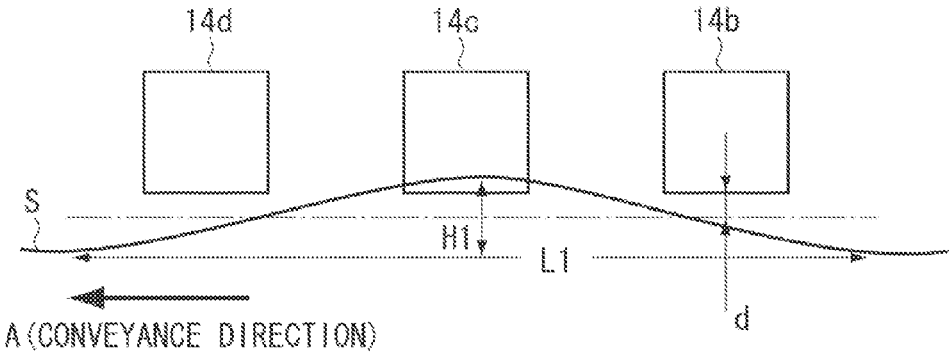
FIGS. 7A, 7B, and 7C are sectional views illustrating how a sheet is conveyed to the printing unit.

Here, the significance of the inclined (offset) construction will be illustrated with reference to FIGS. 7A through 7C. FIG. 7A is a model diagram illustrating a sheet corrugation differing in length from place to place formed at the time of the manufacture of a roll sheet. In the diagram, the alternate long and short dashed line indicates the cross-sectional shape of the sheet central portion, and the solid line indicates the cross-sectional shape of the sheet corrugation at the sheet ends. It will be assumed that the corrugation is in the form of a wave of a fixed frequency, and the wavelength thereof will be defined as L1, and the maximum amplitude thereof as H1. In this example, in connection with the printing head 14, the maximum amplitude H1/2 exceeds the determined distance d between the printing head and the sheet conveyance surface.

Depending upon the sheet manufacturing method, the central portion of the sheet may be longer than the end portion thereof. In this case, the end portions are of a linear shape as indicated by the alternate long and short dashed line, and the central portion is of a corrugated shape as indicated by the solid line. Further, depending upon the sheet manufacturing method, the entire sheet may be corrugated; in this case, both the central portion and the end portions are of a corrugated shape as indicated by the solid line.

Figure 7B:
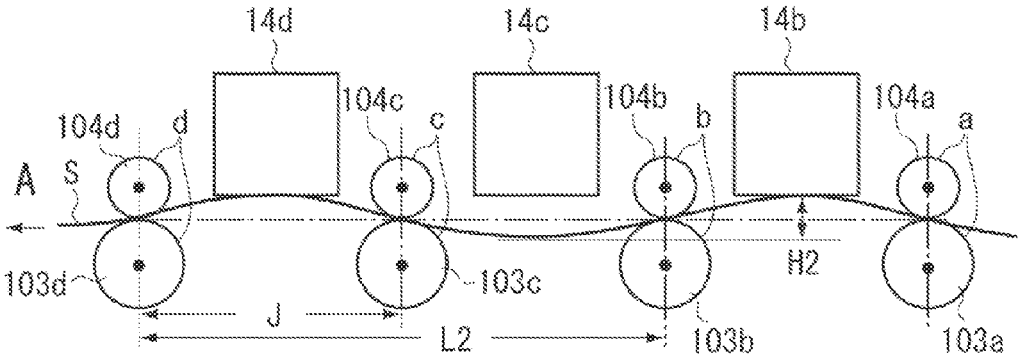

FIG. 7B is a model diagram illustrating a conventional example (comparative example). Each of a plurality of roller pairs is formed such that the imaginary plane including two rotation axes is parallel to a plane extending perpendicularly with respect to the sheet conveyance direction A, and is not inclined with respect thereto. The imaginary plane in contact with the nipping position of the roller pair is parallel to the conveyance direction A. The driven roller is offset neither downstream nor upstream with respect to the driving roller. In such a model, the shape of the central portion of the sheet S conveyed while held by a plurality of roller pairs is linear as indicated by the alternate long and short dashed line. The end portions of the sheet S are corrugated as indicated by the solid line; however, the magnitude of the wavelength thereof is different from that of FIG. 7A.

A wave node is formed at each nipping position where the sheet is held by each roller pair. Assuming that the distance between the adjacent roller pairs is J, half the wavelength is J, so that the wavelength L2 is expressed by the following equation (1):

$$L2=2\times J \tag{1}$$

The maximum amplitude H2 of the corrugated sheet is expressed by the following equation (2):

$$H2=H1\times(L2/L1)=H1\times(2J/L1) \tag{2}$$

In the present example, the distance J=L1/3. Thus, H2=H1×⅔, which means the maximum amplitude is ⅔ of FIG. 7A. However, even so, there is the possibility that the upper wave portions of the sheet are brought into contact with the ink discharge surface of the printing head. Even if not brought into contact, the distance between the printing head and the sheet surface is varied greatly according to the corrugation, so that the requisite flying time of the ink discharged from the printing head to impingement upon the sheet may vary, making it difficult to perform correct image printing.

Figure 7C:
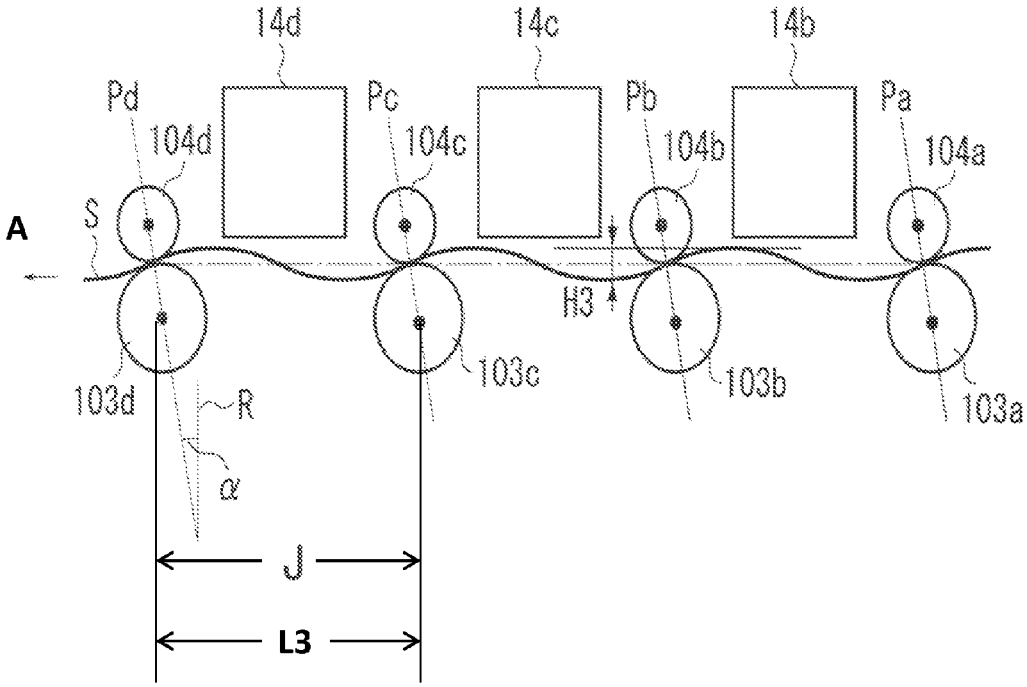

FIG. 7C is a model diagram illustrating the present exemplary embodiment. Each of imaginary planes (Pa through Pd) of the plurality of roller pairs, each including two rotation axes, is inclined toward a plane R perpendicular to the sheet conveyance direction A by an inclination angle $\alpha$ ($\alpha>0$). The imaginary plane in contact with the nipping position of each roller pair is inclined toward the conveyance direction A by an inclination angle (90-α) degrees. The driven roller is offset downstream with respect to the driving roller. In such a model, the shape of the sheet S conveyed while held by the plurality of roller pairs is corrugated at the end portions of the sheet S; however, the wavelength thereof is different from those of FIGS. 7A and 7B. Here, the plurality of roller pairs refer to all of the second conveyance roller group pairs, the supply rollers, and the first conveyance roller pair.

A wave node is formed at each nipping position where the sheet is held by each roller pair. The tangent at the nipping position of each roller pair is inclined toward the conveyance direction A, resulting in a corrugated shape of a waveform in which the portions before and after the nodes extend in an inclined tangential direction. More particularly, on the upstream side of each nipping position, a force displacing the sheet upwards is exerted, whereas, on the downstream side thereof, a force displacing the sheet downwards is exerted. As illustrated in FIG. 7C, this results in a waveform in which the distance J between the adjacent roller pairs is 1 wavelength. In other words, the wavelength is reduced by half as compared with the case of FIG. 7B.

Assuming that the wavelength is L3, and that the maximum amplitude is H3, the maximum amplitude H3 of the corrugated sheet is expressed by the following equation (3):

$$H3=H1\times(L3/L1)=H1\times(J/L1)=H1/3 \quad (3)$$

From comparison of equation (3) with the above equation (2), H3=H2/2. In other words, as compared with the model of FIG. 7B, the maximum amplitude is ½. As compared with the model of FIG. 7A representing the natural state, the maximum amplitude is ⅓.

In this way, in the construction of the present exemplary embodiment, it is possible to reduce the maximum height of the corrugated sheet at the printing portion, so that the possibility that the upper portions of the waves of the sheet come into contact with the ink discharge surface of the printing head, can be reduced. In other words, it is possible to further reduce the distance between the sheet and the printing head. Further, since the change in the distance between the printing head and the sheet surface is small, it is possible to perform more correct image printing.

Figure 8:
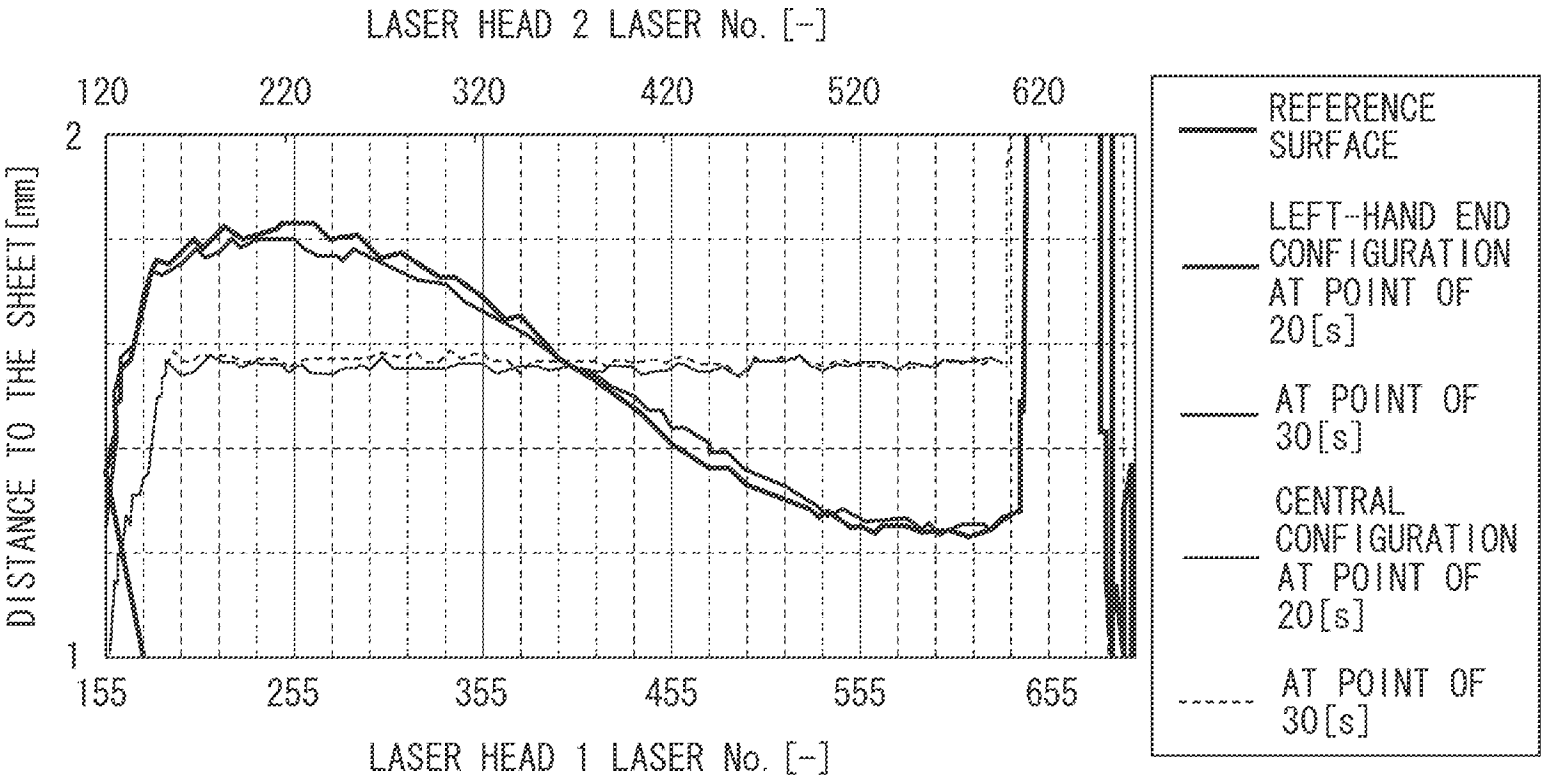
FIG. 8 is a graph in which distance to sheet surface is measured and plotted.

FIG. 8 is a graph in which the distance to the sheet surface when conveying a sheet in the printing apparatus of the present exemplary embodiment is measured and plotted. Here, the corrugation wavelength L1 of the used sheet in the natural state=150 to 200 [mm], and the maximum amplitude H1=2 to 3 [mm]. The distance J between the roller pairs included in the second conveyance roller group=50 to 60 [mm]. A line laser displacement gage is used for the measurement. The laser displacement gage applies a laser beam from a light emitting portion to an object and measures the time the reflected light takes to return to a light receiving portion, to measure the distance to the object. A line laser displacement gage having two laser heads is installed at a position equivalent to an arbitrary printing head, and the distance to the sheet surface is measured at two positions: the sheet central portion in the width direction thereof and a sheet end portion (left-hand end). The measurement is performed twice: at a point of 20 s, and a point of 30 s.

From the plotting in FIG. 8, it can be seen that the sheet shape at the central portion is maintained substantially horizontal. At the sheet end portion, the corrugation wavelength L3=50 to 60 [mm], and the maximum amplitude H3=0.5 to 0.6 [mm]. This indicates the same tendency as the above ideal model equation (3), which means the measurement result of FIG. 8 supports the effects of the present invention.

In this way, inclination (offsetting) is effected in the same direction in arbitrary adjacent upstream and downstream roller pairs among a plurality of roller pairs to achieve the effect as mentioned above. The above equation only shows the relationship in the ideal model, and the actual apparatus may involve some difference; however, any such actual apparatus falls within the scope of the present invention so long as it provides the above effect.

In the above description, the behavior of the sheet is illustrated when it is passing the printing unit 4 during printing operation. When the sheet is first introduced into the printing unit 4, the leading edge of the sheet S is sequentially introduced from the upstream toward the downstream side between a plurality of roller pairs. At this time, as illustrated in FIG. 7C, at each roller pair, the tangent passing the sheet nipping position is inclined downwardly, so that when the sheet is guided to the next roller pair, it is not horizontal but is directed somewhat downwardly. For example, immediately after the sheet leading edge intrudes into the roller pair consisting of the driving roller 103*a* and the driven roller 104*a*, the sheet leading edge is directed not horizontally but somewhat downwardly (in a direction away from the printing head 14*b*).

A guide member 112 is raised on the downstream side and lowered on the upstream side with respect to the sheet conveyance direction A and only the raised portion is in contact with the reverse side of the sheet. The guide is only needed for the initial sheet introduction; thus, in FIG. 6, it is also possible for movable guides 212*b* and 213*b* to guide the reverse sheet side only when the sheet leading edge passes, and to retreat to positions where no ink is imparted when the printing is started. With this guide structure, it is possible to restrain the sheet from getting under the roller pair on the downstream side. Further, it is possible to suppress soiling of the guide surface with ink; in duplex printing described above, the sheet whose first surface has undergone printing is reversed at the reversing unit 9, and is supplied again to the printing unit 4, where printing is performed on the second surface thereof. At the time of printing of the second surface, the first surface, on which an image has already been formed, faces downward, so that if large friction is applied to this surface, the formed image can be damaged or soiled. Thus, to avoid that, it is highly significant to minimize the contact of the surface with the guide.

On the other hand, in the case in which the inclining direction of the roller pairs is opposite to that of FIG. 7, in other words, in the case in which the driven roller is offset to be situated on the upstream side of the driving roller with respect to the conveyance direction A, a different behavior appears. In each roller pair, the tangent to the nipping position of the sheet is upwardly inclined, so that the direction in which the sheet is guided to the next roller pair is not horizontal but somewhat upward. Thus, before the leading edge of the sheet reaches the next roller pair, there is a possibility that the sheet leading edge comes into contact with the nozzle discharge surface of the printing head. In the case where the determined distance d between the printing head and the sheet conveyance surface is small, the possibility that they come into contact with each other becomes higher.

From this point of view, the inclining direction as illustrated in FIG. 7*c* is more desirable. However, even in the case of the inclining direction of FIG. 7C, when the trailing edge of the sheet S passes through and leaves the printing unit, there is a possibility that the trailing edge of the sheet having left the roller pair in the most downstream side is raised to bring the sheet trailing edge into contact with the nozzle discharge surface of the printing head.

To avoid such contact between the sheet and the printing head 14, the printing head 14 is caused to move temporarily away from the sheet at least either when the sheet is introduced into the printing head 14 or when the sheet leaves the same.

Figure 9:
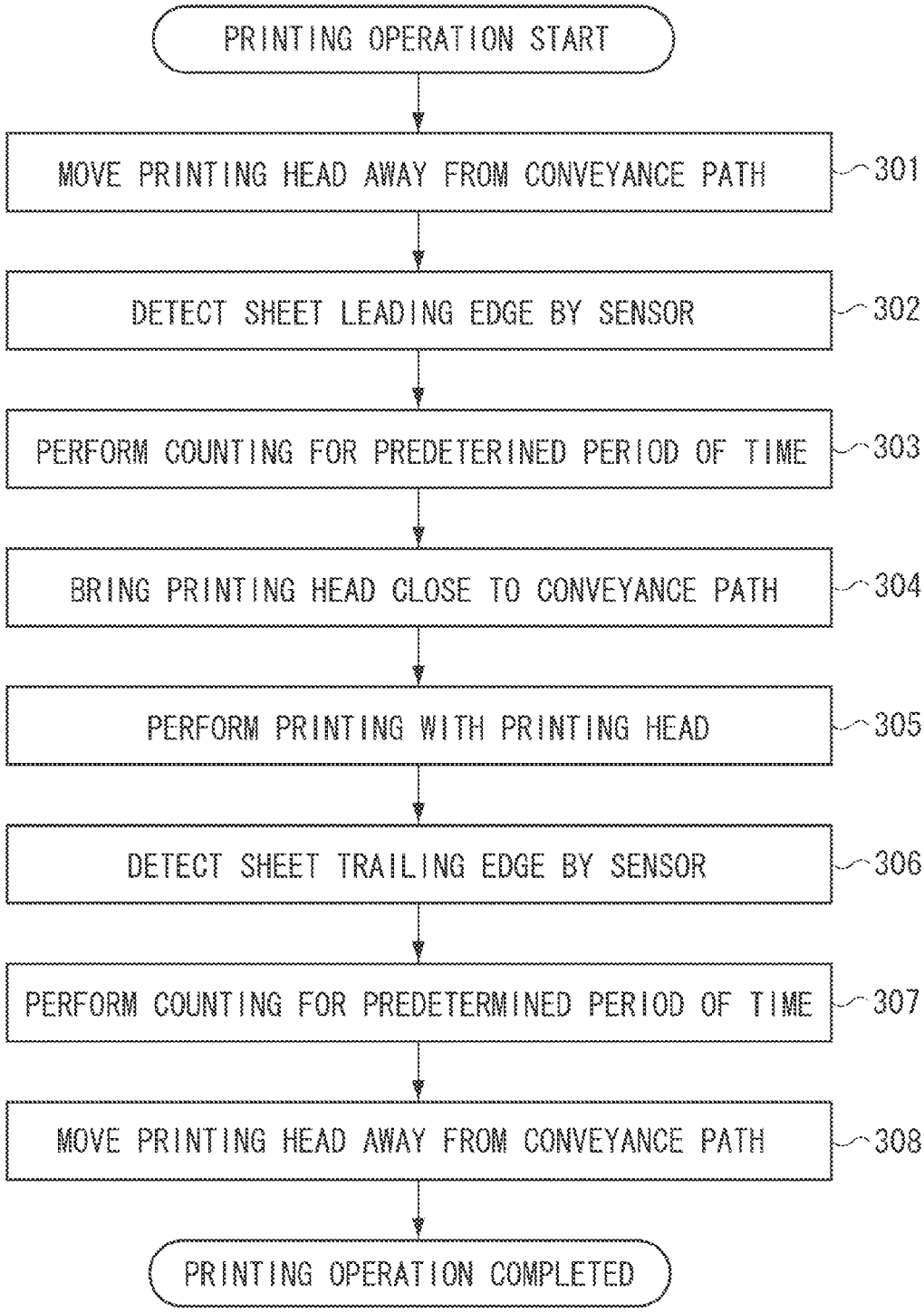
FIG. 9 is a flowchart illustrating the operational sequence of the printing apparatus.

FIG. 9 is a flowchart illustrating the operational sequence executed under control of the control unit 13. In step 301, at the time of printing start, the printing head 14 is moved away from the sheet conveyance path by a drive mechanism 131. In step 302, the leading edge of the sheet S supplied to the printing unit 4 from the sheet supply unit 1 or the reversing unit 9 is detected by a sensor 130 provided in the vicinity of the inlet of the printing unit 4. In step 303, counting is performed until a predetermined time has elapsed, which corresponds to the time until the sheet is held by the most upstream roller pair of the printing unit 4. When the counting has been completed, the procedure advances to step 304, where the printing head 14 is displaced toward the sheet conveyance surface by the drive mechanism 131 until the distance d suitable for printing is attained. When the sheet leading edge is introduced, the printing head 14 retreats upwards, so that even in the case where the sheet is guided upwards by the roller pair, it is possible to prevent the sheet leading edge from coming into contact with the ink discharge surface of the printing head 14*a*.

In step 305, a plurality of images is successively printed on the sheet by the printing head 14. As described above, even if corrugation is generated in the sheet S during printing, the maximum amplitude is minimized, so that the fluctuation in the distance between the sheet and the printing head 14 is small.

In step 306, the sensor 130 detects the sheet trailing edge. In step 307, there is counted a predetermined period of time corresponding to the time up to immediately before the arrival of the sheet trailing edge at the most downstream roller pair of the printing unit 4. When the counting has been completed, the procedure advances to step 307, where the printing head 14 is moved away from the sheet conveyance surface by the drive mechanism 131. In this way, the printing operation is completed. When the sheet trailing edge leaves the last roller pair, the printing head 14 retreats upwards, so that even if the sheet trailing edge is raised, it is possible to prevent the sheet trailing edge from coming into contact with the ink discharge surface of the printing head 14.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-265756 filed Nov. 29, 2010, which is hereby incorporated by reference herein in its entirety.

What is claimed is:

1. A printing apparatus comprising:

a printing head;

an upstream roller pair arranged on an upstream side of the printing head with respect to a direction in which a sheet is conveyed; and a downstream roller pair arranged on a downstream side of the printing head with respect to the direction, wherein each of the upstream roller pair and the downstream roller pair includes a first roller and a second roller configured to nip the sheet therebetween, and wherein in both of the upstream roller pair and the downstream roller pair, a rotation shaft of the second roller is provided to be situated on the downstream side of a rotation shaft of the first roller with respect to the direction when the first roller and the second roller nip the sheet therebetween.

2. The printing apparatus according to claim 1, wherein, between the upstream roller pair and the downstream roller pair, the sheet being conveyed exhibits an upwardly curved portion and a downwardly curved portion, and no other member than the upstream roller pair and the downstream roller pair comes into contact with the sheet.

3. The printing apparatus according to claim 2, wherein the printing head performs printing on the sheet at a position between an apex of the upwardly curved portion and an apex of the downwardly curved portion of the sheet.

4. The printing apparatus according to claim 1, wherein a rotational peripheral speed of the downstream roller pair is higher than a rotational peripheral speed of the upstream roller pair, and wherein a nipping force with which the upstream roller pair holds the sheet is larger than a nipping force with which the downstream roller pair holds the sheet.

5. The printing apparatus according to claim 1, wherein the second roller is in contact with a printing surface of the sheet on which printing is performed by the printing head, and wherein the rotation shaft of the second roller is situated on the downstream side of the rotation shaft of the first roller with respect to the direction.

6. The printing apparatus according to claim 1, further comprising a guide member which, when a leading edge of the sheet having passed the upstream roller pair is introduced into the downstream roller pair, comes into contact with a back side of the printing surface of the sheet in the vicinity of the downstream roller pair and which does not come into contact with a back side of the printing surface in the vicinity of the upstream roller pair.

7. The printing apparatus according to claim 6, wherein the guide member is configured to retreat when the leading edge of the sheet is held by the downstream roller pair.

8. The printing apparatus according to claim 1, wherein the printing head is configured to retreat away from the printing surface of the sheet when the leading edge of the sheet having passed the upstream roller pair is introduced into the downstream roller pair.

9. The printing apparatus according to claim 1, further comprising a supply unit holding a continuous sheet in the form of a roll.

10. The printing apparatus according to claim 1, wherein a plurality of the printing heads of inkjet-type are arranged along the direction, and the upstream roller pair and the downstream roller pair are provided in each of the plurality of the printing heads.

11. The printing apparatus according to claim 1, further comprising a sheet supply unit configured to hold and supply a continuous sheet;

a printing unit equipped with the printing head configured to perform printing on the sheet supplied from the sheet supply unit;

a cutter configured to cut the sheet at a position on the downstream side of the printing unit; and a reversing unit configured to reverse the sheet having passed the cutter and to supply the same to the printing unit again, wherein the sheet supplied from the sheet supply unit undergoes printing on a first surface at the printing unit;

the sheet having undergone printing is guided to the reversing unit;

the sheet supplied to the printing unit again from the reversing unit undergoes printing on a second surface on a back side of the first surface; and the sheet having undergone printing on the second surface is cut by the cutter before being discharged.

12. A printing apparatus comprising:

a printing head;

an upstream roller pair arranged on an upstream side of the printing head with respect to a direction in which a sheet is conveyed; and a downstream roller pair arranged on a downstream side of the printing head with respect to the direction, wherein each of the upstream roller pair and the downstream roller pair includes a first roller and a second roller configured to nip the sheet therebetween, and wherein in both of the upstream roller pair and the downstream roller pair, the positional relationship between the first roller and the second roller is determined such that a plane defined to include a rotation shaft of the first roller and a rotation shaft of the second roller is inclined in the same direction in both of the upstream roller pair and the downstream roller pair, toward a plane perpendicular to the direction when nipping the sheet therebetween.

13. A sheet conveyance apparatus comprising:

an upstream roller pair configured to rotate while holding a sheet; and a downstream roller pair arranged on a downstream side of the upstream roller pair with respect to a direction in which the sheet is conveyed, wherein each of the upstream roller pair and the downstream roller pair includes a first roller and a second roller configured to nip the sheet therebetween, and wherein in both of the upstream roller pair and the downstream roller pair, a rotation shaft of the second roller is provided to be situated on the downstream side of a rotation shaft of the first roller with respect to the direction when the first roller and the second roller nip the sheet therebetween.

* * * * *